United States Patent [19]

Korthaus

[11] Patent Number: 4,664,606

[45] Date of Patent: May 12, 1987

[54] RECIPROCATING PUMP FOR FLUIDS, SPECIFICALLY SUCH CONTAMINATED BY SOLIDS

[76] Inventor: Ernst Korthaus, Sonnenstrasse 112, 4600 Dortmund 1, Fed. Rep. of Germany

[21] Appl. No.: 679,039

[22] PCT Filed: Apr. 3, 1984

[86] PCT No.: PCT/EP84/00092

§ 371 Date: Nov. 30, 1984

§ 102(e) Date: Nov. 30, 1984

[87] PCT Pub. No.: WO84/03913

PCT Pub. Date: Oct. 11, 1984

[51] Int. Cl.[4] ..... F04B 21/02

[52] U.S. Cl. ..... 417/454; 417/537; 417/566

[58] Field of Search ..... 417/534, 536, 537, 454, 417/566

[56] References Cited

U.S. PATENT DOCUMENTS

| | | | |
|---|---|---|---|
| 180,701 | 8/1876 | Maxwell et al. | 417/543 |
| 188,450 | 3/1877 | Wheeler | 417/537 |
| 340,020 | 4/1886 | Waters | 417/543 |
| 597,368 | 1/1898 | Worthington | 417/537 |
| 683,542 | 10/1901 | Worthington | 417/537 |
| 1,445,035 | 2/1923 | Pocock | 417/454 |
| 1,877,873 | 9/1932 | Holmgreen | 417/900 |
| 2,491,230 | 12/1949 | Theis | 417/536 |
| 2,609,756 | 9/1952 | Wright et al. | 417/454 |
| 2,646,000 | 7/1953 | Schmidt | 417/900 |
| 2,895,424 | 7/1959 | Tramonti et al. | 417/454 |
| 3,077,204 | 2/1963 | Bennett et al. | 417/900 |
| 3,298,319 | 1/1967 | Savage | 417/900 |
| 3,684,406 | 8/1972 | Edwards | 417/454 |
| 4,252,510 | 2/1981 | Bromley | 417/534 |

FOREIGN PATENT DOCUMENTS

| | | | |
|---|---|---|---|
| 2103530 | 1/1971 | Fed. Rep. of Germany | 417/900 |
| 569199 | 4/1924 | France | 417/454 |
| 1157126 | 12/1957 | France . | |
| 7590 | of 1912 | United Kingdom . | |
| 566936 | 1/1945 | United Kingdom . | |

*Primary Examiner*—Carlton R. Croyle
*Assistant Examiner*—Paul F. Neils
*Attorney, Agent, or Firm*—Mueller and Smith

[57] ABSTRACT

The invention concerns a reciprocating pump for liquid substances, specifically such contaminated by solids. To render such a reciprocating pump self-cleaning, it is suggested to arrange the intake chamber (7), pressure chamber (2), and the pressure chamber (8) side by side in a horizontal or only slightly declining plane, to arrange the check valves (9, 10, 11, 12) side by side in the same horizontal or slightly declining plane, and to have the pressure socket (20) empty on the bottom side of the pressure chamber. In addition, the intake socket (19) empties suitably from below, vertically or at least steeply rising, into the intake chamber. This design ensures that the paths within the pump extend essentially horizontally or only slightly upwardly, so that any solid particles which have proceeded into the pump housing can be carried out of the pump again.

6 Claims, 5 Drawing Figures

Figure 3:
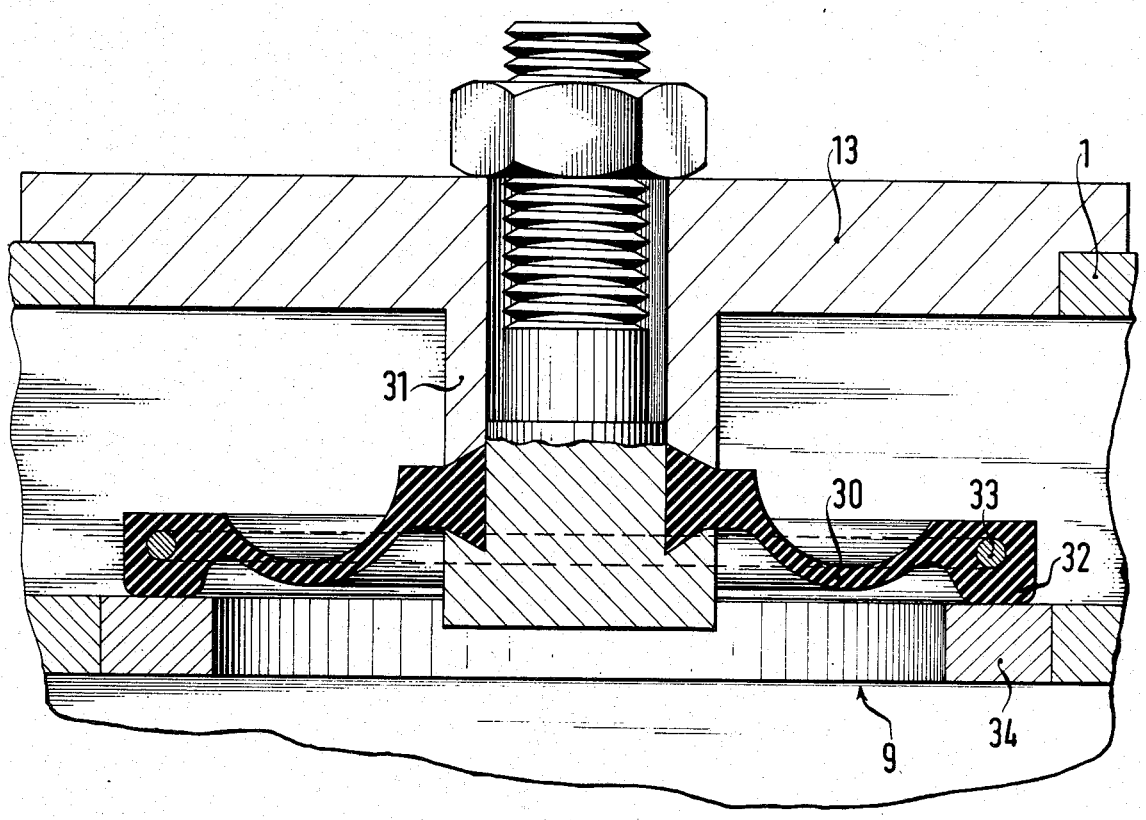

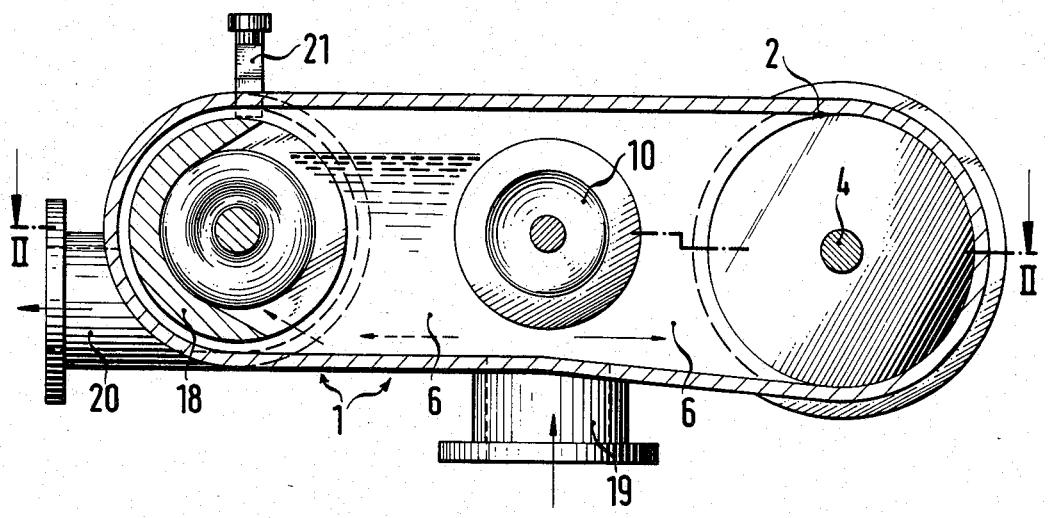
FIG. 1
FIG. 2
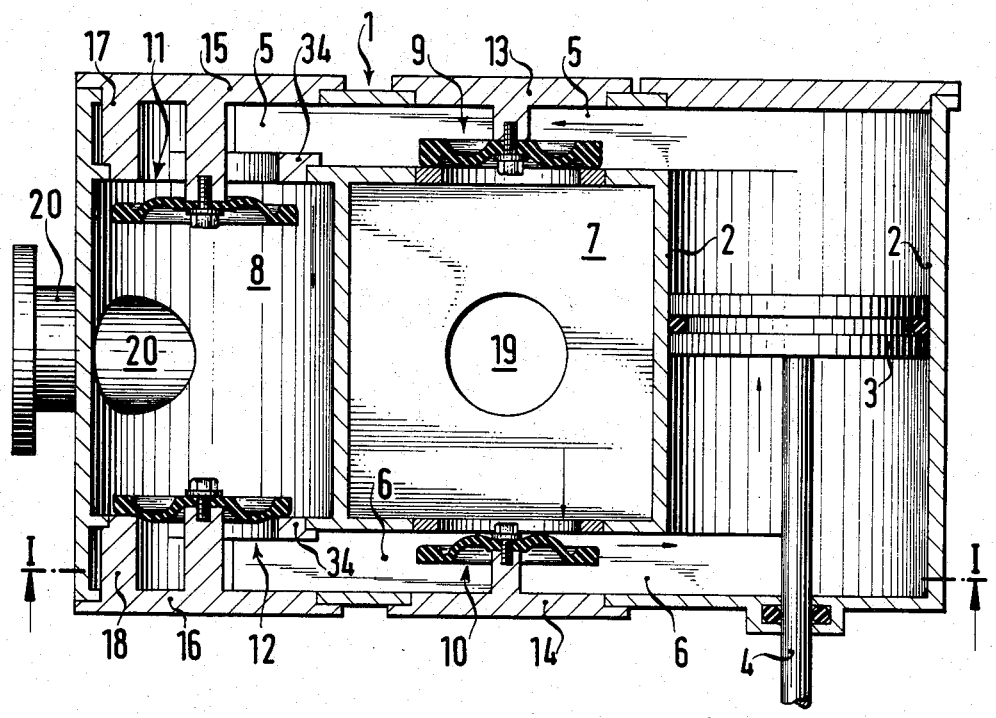

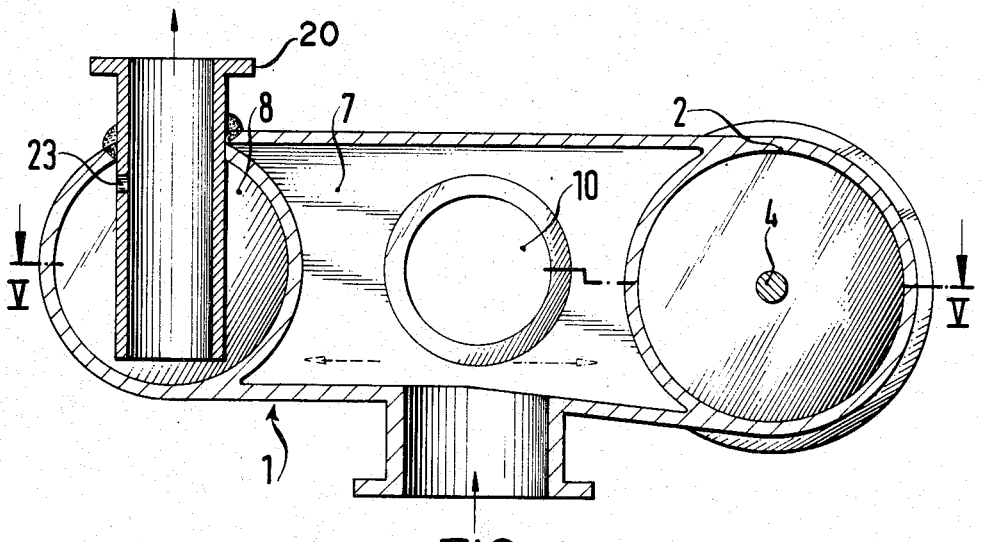
FIG. 4
FIG. 5
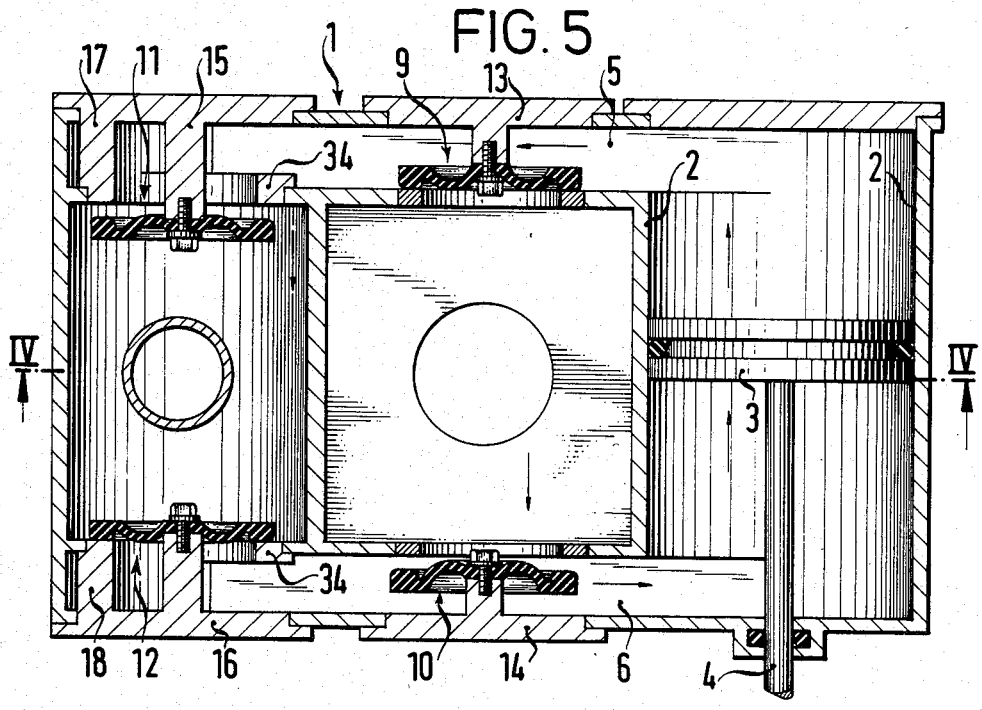

RECIPROCATING PUMP FOR FLUIDS, SPECIFICALLY SUCH CONTAMINATED BY SOLIDS

The invention concerns a reciprocating pump for fluids, specifically such contaminated by solids, comprising a plunger reciprocating in a pump cylinder to the interior of which there are connected, through the intermediary of check valves working in opposite directions, an intake chamber featuring the intake socket of the reciprocating pump and a pressure chamber featuring the pressure socket of the reciprocating pump.

On state of the art reciprocating pumps of that type the pressure chamber is normally arranged above the pump cylinder. Specifically the check valves (pressure valves) coordinated with the pressure chamber are always arranged at the highest point of the interior space. Besides, the pressure socket on the pressure chamber empties mostly above the pump cylinder. This was heretofore considered mandatory, since it makes it possible to prevent air bubbles to remain behind in the interior of the pump. For the air bubbles stemming from the liquid intake or from direct intake cannot accumulate in the pump housing, but are removed instead through the elevated pressure valves. This is to counteract the danger that the reciprocating pump will compress the air that has been sucked in, and not do any pumping work.

A drawback of the prior reciprocating pumps of said type is constituted by the fact that they clog relatively easily through solids carried by the fluid being pumped. This is particularly disadvantageous when contaminated substances, e.g., waste water at construction sites or similar, are to be pumped. The solid particles proceed with the intake flow relatively easily through the intake valves and remain then in the space between the intake valves and the pressure valves, since they are unable to follow the steeply rising pump flow. This is true especially for solid particles having a greater specific gravity than the substance being pumped, for instance rocks, sand or similar. Therefore, separators for rocks or other coarse dirt particles are usually installed in the intake line of reciprocating pumps of said type. But such rock separators clog easily, for instance through leaves or similar floating in the waste water, and are unable to retain small rocks or solid particles, which as well may clog the pump. In contrast, it would be better to make the reciprocating pump self-cleaning, precluding clogging by entrained solid particles.

Therefore, the problem underlying the invention is advancing the reciprocating pump of the initially named type to the effect that solid particles carried by the substance being pumped, and which have passed the intake valve, will be safely removed from the pump through the pressure valves, the pressure chamber, and the pressure socket.

As a solution to the problem the invention suggests, basing on a reciprocating pump of the initially named type, that the intake chamber, pump cylinder, and the pressure chamber be arranged side by side in a horizontal or only slightly inclined plane, that the check valves be arranged side by side in the same horizontal or slightly inclined plane, and that the pressure socket empty on the underside of the pressure chamber.

On its way through the intake chamber to the intake valve, from the intake valve to the pump cylinder, from the pump cylinder to the pressure valve, and through the pressure chamber to the pressure socket, the pumped substance follows in the inventional reciprocating pump essentially horizontal or slightly rising paths, ensuring that the solid particles will continue to proceed along the bottom of the horizontal paths in a rolling or sliding fashion. Even if solid particles of especially heavy specific gravity should settle on the bottom of the pumping path, such will not affect the continued pumping ability and self-cleanability of the inventional reciprocating pump, since such deposits will constrict the pumping paths and thereby raise the flow velocity, so that at least the solid particles proceeding subsequently into the pump will be entrained along the horizontal pumping paths, thereby precluding a complete clogging of the pump. In the pump cylinder of the inventional reciprocating pump, air bubbles can form only above the top edge of the pressure valve. Suitable design measures make it possible to keep the forming air bubble, in contingence on the maximally possible counterpressure, so small that an interruption of the fluid pumping action through compression and expansion of the air bubble in the pump cylinder will not be possible.

A preferred embodiment of the inventional reciprocating pump provides for a pressure socket which from the underside of the pressure chamber to its top extends at an upward slope wile featuring in the top side area a vent which empties into the pressure chamber and has a small diameter. With the reciprocating pump design, the vent in the top side of the pressure chamber prevents the accumulation of air in the pressure chamber, which might proceed into it through pressure valve leakage. Naturally, the pressure socket has a diameter which is smaller, or at least not larger, than that of the intake socket, so as to safeguard despite a rising flow path a reliable removal of solids sucked in and advanced by the pump.

An alternative design provides for a pressure socket which from the underside of the pressure chamber extends downward, horizontally, or slightly upward, and for a pressure chamber featuring at the top an air relief valve. With this reciprocating pump design, the air relief valve ensures the air removal from the pressure chamber. Due to the horizontal, declining, or at least slightly rising extension of the pressure socket, solids contained in the substance being pumped are removed better yet.

A favorable advancement of the inventional reciprocating pump provides for the intake socket to empty into the suction chamber from below, vertically or at least steeply rising. This ensures even before the intake chamber the retention of solid particles whose settling velocity, due to a particularly heavy specific gravity, is greater than the flow velocity of the substance being pumped. For solid particles which have negotiated the vertical or steeply rising intake socket it may be presumed that they will subsequently pass the horizontal or slightly rising reciprocating pump paths without any problem.

To avoid that solids floating in the substance being pumped, i.e., leaves, threads, or similar carried along, will settle in the area of the check valves, the invention provides additionally for a check valve design as diaphragm valve with an uninterrupted circular passage cross section where the diaphragm features on the outer circumference a stiff bead bearing on the valve seat, where the valve is in pressure direction ring-shaped, concave and mounted in the center on a fixed stud. Such diaphragm valves have an especially large stroke and, consequently, open up large passage cross sections without requiring for the valve body any stays or support grids which would constrict the passage cross section. Owing to the ring-shaped concave design of the diaphragm in pressure direction in conjunction with the stiff bead, the diaphragm valve is suited for relatively high pressures. Mounted centrally on the stud, connecting outside with the stiff bead, and having in pressure direction a ring-shaped concave design, the diaphragm causes the valve to absorb the pressure load according to the diaphragm theory, i.e., through tensile stresses and not through bending stresses. The elastic materials being able to absorb considerably greater tensile than bending stresses, it is possible to make the diaphragm relatively thin so that it will easily bend back and open a large opening cross section as the valve opens, while still being able to absorb high liquid pressures in closed position.

The diaphragm and the bead of the check valves consist suitably of rubber-elastic material, with a steel ring embedded in the bead for higher liquid pressures. This makes it possible to give the bead a relatively small cross section and great stiffness, so that only small forces of gravity occur as the valve is operated. The embedded steel ring prevents the bead from buckling at a point along its circumference, under the effect of the tensile load attacking the diaphragm, and from thereby causing a leakage of the valve.

In order for the pump housing and the check valves to permit easy cleaning, if required, the check valves are mounted on pump housing covers which can be detached from the pump housing. The detachable connection of the housing covers may be effected, as the case may be, through suitable fast-action closures making the valves and the interior of the pump quickly accessible.

To avoid dead spaces in the pumping path to the pressure space, the housing covers coordinated with the pressure chamber are suitably provided with filler pieces which, before the check valves, fill out the dead corners in the feed channels of the pressure chamber and form slide-on ramps which extend up to the bottom edge of the valve passageway. These filler pieces occupy the dead spaces where solid particles could accumulate and additionally route the solid particles rolling or sliding along the bottom toward the pressure valve, so that these can pass through the pressure valve without hindrance.

An embodiment of the invention will be more fully explained hereafter with the aid of the drawing, showing in FIG. 1, a vertical section through an inventional reciprocating pump along line A-B in FIG. 2;

FIG. 2, a horizontal section through the reciprocating pump presented in FIG. 1, along line C-D in FIG. 1;

FIG. 3, a horizontal section through a check valve coordinated with the intake chamber, FIG. 4, a vertical section through an inventional reciprocating pump in a second design along line E-F in FIG. 5;

FIG. 5, a horizontal section through the reciprocating pump illustrated in FIG. 4, along line G-H in FIG. 4.

In the drawing, 1 marks the pump housing in its entirety. Arranged inside the pump housing 1 is a pump cylinder 2 which accommodates in its interior a double-acting, reciprocating plunger 3. The plunger 3 is connected with a piston rod 4 which, in turn, connects with a not illustrated drive, for instance a hydraulic drive cylinder or a crank gear. Connecting with the interior of the pump cylinder 2, through narrow channels 5 and 6, are an intake chamber 7 and a pressure chamber 8 which, the same as the pump cylinder 2, are located side by side in a horizontal plane in the pump housing 1. The channel 5 connects with the interior space of the pump cylinder 2 on the near side of the full face of the plunger 3, while the channel 6 connects with the interior space of the pump cylinder 2 on the near side of the annular face of the plunger 3. Incorporated in the channels 5 and 6 are check valves 9 and 10 which are coordinated with the intake chamber 7, permit the passage of the pumped substance from the intake chamber 7 to the channels 5 and 6, and prevent a return of the pumped substance from the channels 5 and 6 to the intake chamber 7. Similarly, check valves 11 and 12 are coordinated with the pressure chamber 8 which permit the passage of the pumped substance from the channels 5 and 6 to the pressure chamber 8, but prevent a return of the pumped substance from the pressure chamber 8 to the channels 5 and 6.

The check valves 9, 10, 11, and 12 are mounted each on housing covers 13, 14, 15, and 16 which are detachably connected with the pump housing 1. The connection between the housing covers 13, 14, 15, and 16 is established through screws or suitable fast-action closures. The housing covers 15 and 16 coordinated with the pressure chamber 8 are provided each with filler pieces 17 and 18 which fill out the dead corners in the channels 5 and 6 to the pressure chamber 8 and form slide-on ramps which extend up to the level of the underside of the passageways of the check valves 12 and/or 13.

An intake socket 19 emptying vertically from below is connected with the underside of the intake chamber 7. With the embodiment according to FIGS. 1 and 2, a horizontally emptying pressure socket 20 is located sideways and toward the bottom on the pressure chamber 8. In addition, the pressure chamber 8 features in this embodiment an air relief valve 21, on its top side.

As follows from the drawing, the pump cylinder 2, intake chamber 7, pressure chamber 8, channels 5 and 6, and all check valves 9, 10, 11, 12 are arranged in the same horizontal plane, as a result of which, inside the pump housing and behind the vertical intake socket 19, essentially horizontal pumping paths are created which in the explained manner enable a self-cleaning of the pump.

Shown in FIG. 3, enlarged, is a check valve 9 detail. The same as the other check valves 10, 11, and 12, this check valve 9 features a concave diaphragm 30 from rubber-elastic material, which is mounted on a center stud 31. On its periphery, the diaphragm 30 is provided with a stiff bead 32 from rubber-elastic material in which a stiffening steel ring 33 is embedded. In the closed position of the valve, the bead 32 bears on a ring-shaped valve seat 34 of the pump housing 1 and, in opening position, lifts off the valve seat 34 with its entire circumference.

In pressure direction, the diaphragm 30 has a ring-shaped concave design such that it, bearing with the bead 32 and on the stud 31, can absorb the pressure load exclusively through tensile stresses, in accordance with the diaphragm theory. When pressure is admitted in opposite direction, the diaphragm 30 will bend and the bead 32 can slightly lift off the valve seat 34, opening a large passage cross section which is not restricted by any stays or similar.

The stud 31 is mounted on the housing cover 13 which, in turn, is connected with the pump housing 1. As is evident, the entire check valve 9 can be removed in a simple manner, simply by removal of the housing cover 13.

The check valve 10 is designed the same way as the check valve 9. The check valves 11 and 12 have basically the same design as the check valve 9 detailed in FIG. 3 but, being coordinated with the pressure space 8, they have an opposite working direction. To ensure an easy disassembly of these check valves 11 and 12 as well, the valve seats 34 are connected there with the housing covers 15 and 16 and removed along with these, so that the bead located in the pressure chamber 8 will not hinder the disassembly of the check valve.

FIG. 1 indicates additionally that the air bubble which forms in the pump housing 1 can reach only up to the top edge of the valve passageway of the check valves 11 and 12 coordinated with the pressure chamber. The air-filled space forming in the channels 5 and 6 and in the pump cylinder 2 is obviously so small that it cannot interfere with the proper operation of the pump.

To avoid larger air accumulations in the pressure chamber which through leakage of the check valves 11 and 12 might proceed through the channels 5 and 6 into the pump cylinder 2, the embodiment relative to FIGS. 1 through 3 features on the top side of the pressure chamber 8 the above-mentioned air relief valve 21 through which excess air can continually escape.

With the embodiment relative to FIGS. 4 and 5, the pressure socket marked 20 extends from the underside of the pressure chamber 8 upwardly to its top side and is provided, in the area of the top side, with a vent 23 emptying into the pressure chamber 8. This vent ensures as well that any air which has proceeded into the pressure chamber will be continually removed. In cross section, the pressure socket 23 is smaller than the intake socket 19, or at the most equally large, so that solid particles sucked in and moved on by the pump will be discharged again through the pressure socket, due to the flow velocity created in the pressure socket.

I claim:

1. Reciprocating pump for fluid substances, specifically such contaminated by solids, comprising: a housing, a plunger reciprocating in a pump cylinder within said housing; an intake socket connected to said intake chamber; a pressure chamber; a pressure socket connected to said pressure chamber; fluid passage means for providing fluid communication between said pump cylinder, said intake chamber, and said pressure chamber; first check valve means which provide fluid communication between said intake chamber and said fluid passage means; second check valve means which provide fluid communication between said pressure chamber and said fluid passage means; characterized in that the intake chamber (7), the pump cylinder (2), and the pressure chamber (8) are aligned side by side in a generally horizontal or only slightly declining plane, in that said first and said second check valve means (9, 10, 11, 12) are aligned side by side in the same horizontal or slightly declining plane, in that a plurality of detachable covers are detachably connected to said housing, in that the pressure socket (20, 22) connects to the bottom side of the pressure chamber (8), and in that said first and said second check valve means further are designed as diaphragm valves with an uninterrupted ring-shaped passage cross section, the diaphragms (30) featuring on the outer circumference a stiff bead (32) bearing on the valve seat (34), having in pressure direction a ring-shaped concave design, and being center-mounted in a fixed stud (31) which is connected to one of said covers.

2. Reciprocating pump according to claim 1, characterized in that the pressure socket (20) extends in a generally horizontal direction from the underside of the pressure chamber (8) and that the pressure chamber (8) is provided on its top side with an air relief valve (21).

3. Reciprocating pump according to claim 1, characterized in that the intake socket (19) extends vertically and is connected to the bottom of said intake chamber (7).

4. Reciprocating pump according to claim 1, characterized in that the housing covers (15, 16) which mount the check valve means (11, 12) of the presure chamber (8) are provided with filler pieces (17, 18) between said second check valve means (11, 12) and said fluid passage means which form slide-on ramps that extend up to the level of the bottom edge of said second check valve means.

5. Reciprocating pump for liquid substances, specifically such contaminated by solids, comprising a plunger reciprocating in a pump cylinder, to the interior of which cylinder there are connected, through the intermediary of oppositely working check valves, an intake chamber featuring the intake socket of the reciprocating pump and a pressure chamber featuring the pressure socket of the reciprocating pump, characterized in that the intake chamber (7), the pump cylinder (2), and the pressure chamber (8) are arranged side by side in a horizontal or only slightly declining plane, in that the check valves (9, 10, 11, 12) are arranged side by side in the same horizontal or slightly declining plane, in that the pressure socket (20, 22) empties on the bottom side of the pressure chamber (8), and in that the pressure socket (20) extends rising from the underside of the pressure chamber (8) up to its top side and is provided, in the top side area, with a vent (23) which has a small cross section and empties in the pressure chamber (8).

6. Reciprocating pump for liquid substances, specifically such contaminated by solids, comprising a plunger reciprocating in a pump cylinder, to the interior of which cylinder there are connected, through the intermediary of oppositely working check valves, an intake chamber featuring the intake socket of the reciprocating pump and a pressure chamber featuring the pressure socket of the reciprocating pump, characterized in that the intake chamber (7), the pump cylinder (2), and the pressure chamber (8) are arranged side by side in a horizontal or only slightly declining plane, in that the check valves (9, 10, 11, 12) are arranged side by side in the same horizontal or slightly declining plane, in that the pressure socket (20, 22) empties on the bottom side of the pressure chamber (8), and in that the check valves (9, 10, 11, 12) are designed as diaphragm valves with an uninterrupted ring-shaped passage cross section, the diaphragms (30) featuring on the outer circumference a stiff bead (32) bearing on valve seat (34), having in pressure direction a ring-shaped concave design, and being center-mounted on a fixed stud (31), and in that the diaphragm (30) and the bead (32) of each check valve (9, 10, 11, 12) consist of rubber-elastic material, with a steel ring (33) incorporated in the bead (32).

* * * * *